United States Patent [19]

Jennings, Jr.

[11] Patent Number: 4,938,286

[45] Date of Patent: Jul. 3, 1990

[54] METHOD FOR FORMATION STIMULATION IN HORIZONTAL WELLBORES USING HYDRAULIC FRACTURING

[75] Inventor: Alfred R. Jennings, Jr., Plano, Tex.

[73] Assignee: Mobil Oil Corporation, New York, N.Y.

[21] Appl. No.: 379,755

[22] Filed: Jul. 14, 1989

[51] Int. Cl.[5] ..... E21B 43/267

[52] U.S. Cl. ..... 166/280; 166/50; 166/281; 166/284; 166/297

[58] Field of Search ..... 166/50, 280, 281, 284, 166/297, 298, 308

[56] References Cited

U.S. PATENT DOCUMENTS

| | | | |
|---|---|---|---|
| 3,028,914 | 4/1962 | Flickinger | 166/284 |
| 3,127,937 | 4/1964 | McGuire, Jr. et al. | 166/280 |
| 3,245,866 | 4/1966 | Schott | 166/280 X |
| 3,372,752 | 3/1968 | Prater | 166/280 |
| 3,399,727 | 9/1968 | Graham | 252/8.551 X |
| 4,068,718 | 1/1978 | Cooke, Jr. et al. | 166/280 |
| 4,153,118 | 5/1979 | Hart | 175/4.51 |
| 4,244,425 | 1/1981 | Erbstoesser | 166/284 |
| 4,287,952 | 9/1981 | Erbstoesser | 166/284 |
| 4,476,932 | 10/1984 | Emery | 166/50 X |
| 4,488,599 | 12/1984 | Graham et al. | 166/284 X |
| 4,687,061 | 8/1987 | Uhri | 166/50 X |
| 4,867,241 | 9/1989 | Strubhar | 166/308 |

*Primary Examiner*—George A. Suchfield
*Attorney, Agent, or Firm*—Alexander J. McKillop; Charles J. Speciale; Charles A. Malone

[57] ABSTRACT

A method for stimulating a formation penetrated by a horizontal wellbore where hydraulic fracturing is utilized. The horizontal wellbore casing is perforated on its top side. Thereafter, the formation is fractured through said perforations with a fracturing fluid containing a fused refractory proppant. The density of the proppant selected is equal to the density of the fracturing fluid utilized.

11 Claims, 1 Drawing Sheet

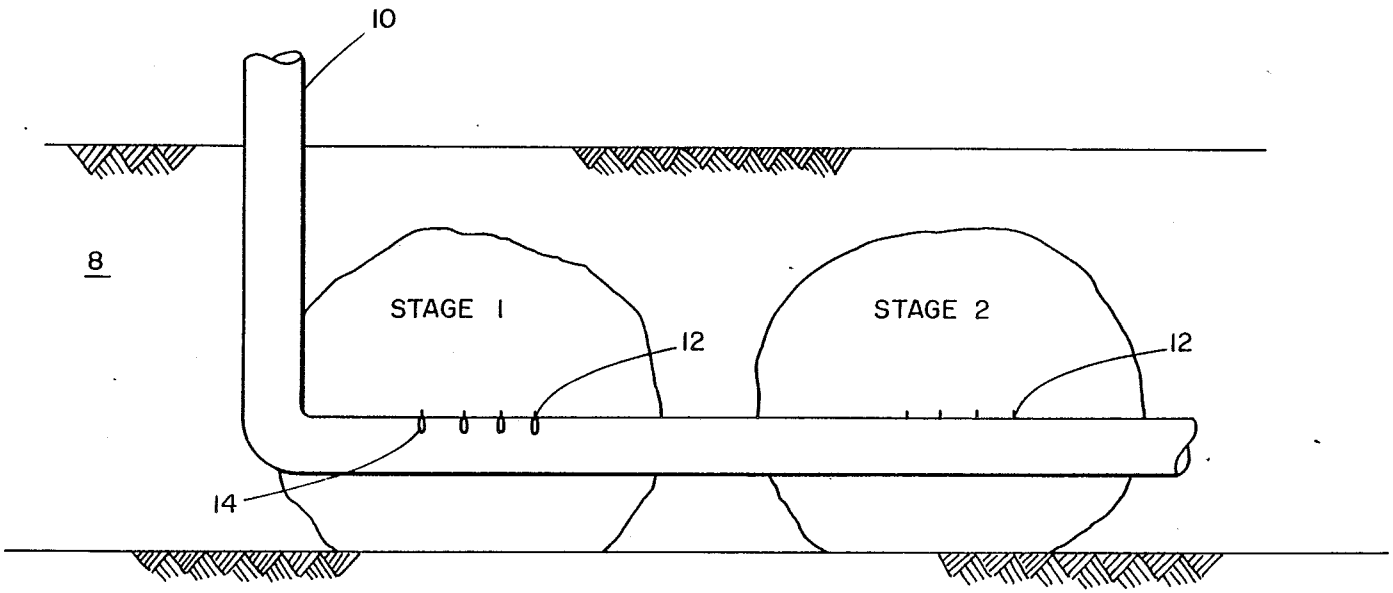
8

METHOD FOR FORMATION STIMULATION IN HORIZONTAL WELLBORES USING HYDRAULIC FRACTURING

FIELD OF THE INVENTION

This invention relates to a method of fracturing subterranean formations surrounding oil wells, gas wells, and similar bore holes. In one aspect, the invention relates to a method which utilizes fused refractory proppants of a desired density for assisting in the fracturing of intervals along a horizontal wellbore.

BACKGROUND OF THE INVENTION

Hydraulic fracturing is a well stimulation technique designed to increase the productivity of a well by creating highly conductive fractures or channels in a producing formation surrounding the well. The process normally involves two basic steps: (1) injecting a fluid at sufficient rate and pressure to rupture the formation, thereby creating a crack (fracture) in the reservoir rock; and (2) thereafter placing a particulate material (propping agent) in the formation to maintain the fracture wall open by resisting forces tending to close the fracture. If stimulation is to occur, the propping agent must have sufficient mechanical strength to bear the closure stresses and provide relatively high permeability in the propped fracture.

With advances in drilling technology, it is currently possible to drill horizontal wellbores deep into hydrocarbon-producing reservoirs. Utilization of horizontal wellbores allows extended contact with a producing formation, thereby facilitating drainage and production of the reservoir. In order to enhance the production from a reservoir, it is often necessary to hydraulically fracture the reservoir through which the horizontal wellbore has penetrated.

Although horizontal wellbores allow more contact with the producing formation, some difficulties are encountered when horizontal wellbores are utilized which are not commonly experienced when vertical wells are used. Methods utilized in producing hydrocarbons from a formation or reservoir via vertical wells often prove to be inefficient when attempting to remove hydrocarbons from a reservoir where horizontal wellbores are being used. This inefficiency results in utilization of increased amounts of fluids used during enhanced oil recovery operations. This results in a diminution in the amount of hydrocarbons removed from the formation or reservoir.

In order to obtain additional production from a formation penetrated by horizontal wellbores, it is often necessary to fracture different intervals of the formation and prop the fracture with a proppant. To this end, a suitable concentration of a particulate propping agent is generally entrained in the fracturing fluid. Rounded sands with uniform particle size distribution have been generally acknowledged to be a preferred propping agent. Glass spheres and metallic shot have also been widely used. Graham et al. in U.S. Pat. No. 3,399,727 disclosed a glass sphere proppant having voids therein which reduced the tendency of said spheres to settle in a fluid suspension utilized within a vertical wellbore. This patent is incorporated by reference herein.

The extent to which productivity or injectivity of a well is improved by fracturing depends on the propped width of the fracture and on the permeability of the propping material when fully loaded by natural compressive stresses. Thus, the distribution of a propping agent within the fracture must be sufficiently dense to bear the imposed load without crushing or embedding and yet not so dense as to seriously reduce permeability. Proppant distributions have been investigated ranging from a 5% partial monolayer to multilayer packs 5 to 6 times the diameter of a single particle.

SUMMARY OF THE INVENTION

This invention is directed to a method for staged fracturing of a formation containing a horizontal wellbore. In the practice of this invention, the top side of the horizontal wellbore is perforated so as to allow a desired interval of the formation to be contacted with a fracturing fluid. Perforations are placed on the top side of the wellbore along a multiplicity of intervals desired to be fractured. Once a desired number of perforations have been placed into the wellbore to fracture desired intervals of formation, a fracturing fluid containing a proppant therein is injected into the wellbore thereby fracturing a first interval of the formation. The fracturing fluid utilized contains a proppant which has a density equal to the density of the fracturing fluid. Materials which can be used for the proppant comprise silica, oxides, glasses, other high-strength ceramic products, sintered alumina, and hard porcelains, such as steatite and mullite.

After fracturing the first interval along the horizontal wellbore, ball sealers in an amount sufficient to close perforations along said first interval are placed into the fracturing fluid thereby closing off that interval. Subsequently, the fracturing fluid containing said proppant is diverted into a different interval of the formation perforations in said horizontal wellbore. Additional ball sealers are injected into the fracturing fluid so as to close off perforations in the second interval of the horizontal wellbore. Afterwards, the fracturing fluid is diverted into a third interval of the formation. This process of fracturing the formation, placing ball sealers in the fracturing fluid to close off the fractured portion or interval of the formation and diverting the fracturing fluid to another interval of the formation through perforations in the horizontal wellbore is continued until such time as the desired intervals of the formation have been fractured. Because the density of the proppants contained in the fracturing fluid is equal to the density of the fracturing fluid, the proppant has a tendency to remain in suspension until the desired intervals of the formation have been fractured along the horizontal wellbore.

It is therefore an object of this invention to increase the relative permeability of a formation which contains a horizontal wellbore by closing one interval in the wellbore with ball sealers and fracturing another interval of the formation through perforations contained therein with a fracturing fluid containing a proppant having a density equal to the fracturing fluid.

It is another object of this invention to use sequential hydraulic fracturing within a horizontal wellbore so as to optimize reservoir drainage from the formation while using a fracturing fluid containing a proppant having a density equal to the fracturing fluid.

It is yet another object of this invention to provide an economical and cost-effective method for controlling the production of hydrocarbonaceous fluids from a formation containing a horizontal wellbore where varying permeabilities are encountered.

It is a still yet further object of this invention to obtain effective stimulation by hydraulic fracturing through a horizontal wellbore so the entire formation interval can be effectively treated by selectively perforating said wellbore and using ball sealers to fracture a desired interval of the formation in combination with a fracturing fluid having a proppant with an equal density.

BRIEF DESCRIPTION OF THE DRAWING

The DRAWING is a schematic representation which depicts a horizontal wellbore with a staged hydraulic fracturing treatment separated by buoyant ball sealers where a fracturing fluid containing a proppant of equal density is utilized.

DESCRIPTION OF THE PREFERRED EMBODIMENTS

In the practice of this invention referring to the drawing, a horizontal wellbore 10 is shown penetrating formation 8. Horizontal wellbore 10 has provided therein perforations 12 which communicate with formation 8. These perforations which are at the top of horizontal wellbore 10 can be made by any type of perforating gun. It is preferred to use those perforation guns such as a jet gun that can provide the roundest and most burr-free perforations which are most amenable to ball sealer seating. Any number of mechanical or magnetic-type decentralized perforating guns can be utilized for perforating along the top of the horizontal casing. The magnetic-type perforating gun uses magnets to orient the perforating gun at the top of the casing. One type of casing gun is disclosed in U.S. Pat. No. 4,153,118. This patent is hereby incorporated by reference. However, it will be obvious to one skilled in the art that other types of perforating guns which can be suitably oriented may also be used in the practice of the method of the present invention. The number of perforations placed into the horizontal wellbore 10 will vary depending upon formation conditions and the productive capacity of the formation. As is shown in the drawing four perforations 12 have been made in one stage of the wellbore 10.

Once the desired number of perforations 12 have been placed into wellbore 10, pressure testing of the pumping and well equipment is commenced. Following the pressure testing, a viscous fluid, frequently referred to as "pad", is injected into the well at a rate and pressure sufficient to initiate and propagate a fracture in formation 8. The earth stresses are such that the fracture normally is along a vertical plane radiating outwardly from the wellbore.

The fluid used to fracture the formation consists of a fracturing fluid and lightweight proppant. The fracturing fluid may be a gel, an oil base, water base, brine, acid, emulsion, foam or any other similar fluid. Said fracturing fluid as is preferred will have a specific gravity from about 0.4 to about 1.2 gm/cc. Normally the fluid contains several additives, viscosity builders, drag reducers, fluid-loss additives, corrosion inhibitors and the like. In order to keep the proppant suspended in the fracturing fluid until such time as all intervals of the formation have been fractured as desired, the proppant should have a density equal to the density of the fracturing fluid utilized.

Proppants which can be utilized herein are comprised of any of the various commercially available fused materials such as silica or oxides as obtainable from Corning or Norton Alcoa. These fused materials can comprise any of the various commercially available glasses or high-strength ceramic products. For example, the common soda-lime-silica glasses have sufficient strength for use as a propping agent in many wells. Preferably the glass should have greater than average strength, including the high-silica glasses, the borosilicate glasses and other known glasses. Other suitable ceramic products include sintered alumina and hard porcelains, such as steatite and mullite. Proppants comprised of glass or other ceramic bodies having internal voids therein may be utilized as is discussed in U.S. Pat. No. 3,399,727 which issued to Graham et al. on Sept. 3, 1968. This patent is hereby incorporated by reference herein. As is preferred, the specific gravity of the proppant will be from about 0.4 to about 1.2 gm/cc.

In practising the invention, silica, oxides, glass or other ceramic proppants are added to the fracturing fluid in a concentration in excess of 10 pounds per gallon, preferably 10–12 pounds per gallon. Once in the fracturing fluid, the proppant-laden fluid is injected into a well in accordance with known fracturing procedures, using conventional equipment. Injection of the "pad" is continued until a fracture of sufficient geometry is obtained to permit placement of the proppant particles. Normally the treatment is designed to provide a fracture width at the wellbore of at least 2 and ½ times the diameter of the largest propping agent particle. Once the fracture of desired geometry is obtained, the propping agent suspended in the fluid is carried and placed into the fracture. Following the placement of the proppant, the well is shut-in for a time sufficient to permit the pressure to bleed off into the formation. This causes the fracture to close and exert a closure stress on the propping agent particles. The shut-in period may vary from a few minutes to several days. A hydraulic fracturing method which can be used herein is disclosed in U.S. Pat. No. 4,068,718 issued to Cooke, Jr., et al. on Jan. 17, 1978. This patent is hereby incorporated by reference.

After fracturing the first interval on the horizontal wellbore 10 to the extent desired, a carrier fluid which can also serve as the hydraulic fracturing fluid is directed into wellbore 10. Into this carrier fluid is placed buoyant ball sealers which are transported down the casing of wellbore 10 where fluid flow causes ball sealers 14 to seat in perforations 12. Ball sealers 14 are held on perforations 12 by the pressure differential across the perforations. Erbstoesser in U.S. Pat. Nos. 4,244,425, issued Jan. 13, 1981, and 4,287,952, issued on Sept. 8, 1981, discusses a method for utilization of ball sealers. These patents are hereby incorporated by reference herein.

Once fracturing has been completed to the extent desired in the first interval, a second interval is selected for perforating. As is done in the first stage, perforations 12 are placed into a second interval of horizontal wellbore 10. Preferably these perforations were made in the horizontal wellbore at the same time that the perforations were made in the first interval. In the interest of greater efficiency, all of the intervals in the formation where it is desired to obtain hydrocarbonaceous fluids should be perforated at the same time. An accurate count should be kept of the number of perforations made in all of the intervals. After the first interval has been fractured, sufficient ball sealers are placed into the carrier or fracturing fluid in an amount sufficient to close off the perforations in the first interval. Afterwards, sufficient pressure is applied to the fracturing fluid to cause ball sealers 14 to close off perforations in the first interval. After those perforations have been closed, fluid will commence flowing through the perforations in the second interval, thereby fracturing the formation adjacent to that interval.

Pressure on wellbore 10 is released which causes the buoyant ball sealers 14 to float upwardly back through wellbore 10 for their subsequent recovery. When it is desired to fracture the next interval of the formation, a sufficient number of ball sealers are directed down wellbore 10 so as to close off the perforations in the first and second intervals of the horizontal wellbore. Thereafter, fracturing pressure is applied through the perforations in horizontal wellbore 10 in an amount sufficient to fracture a third interval of the formation.

After fracturing the third interval, pressure on the wellbore is again released and buoyant ball sealers 14 are again floated upwardly through wellbore 10 to the surface. Additional intervals in the formation can be fractured by placing a number of ball sealers sufficient to close off the intervals which have been previously fractured so as to direct the fracturing fluid into another interval of the formation which is desired to be fractured. The steps of directing a sufficient number of ball sealers into horizontal wellbore 10 to seal off previously fractured perforations and applying fracturing pressure to an unfractured interval of the formation can be repeated until all desired intervals in the formation have been fractured. This process of placing sufficient ball sealers into the formation to close off the perforations and fracturing an additional interval in the formation is defined herein as "modified limited entry". Once all desired intervals in the formation have been fractured, pressure is released on wellbore 10 and formation 8 which causes hydrocarbonaceous fluids to flow through the perforations into the wellbore 8. Production of hydrocarbonaceous fluids can be continued from the formation through the fractured intervals until such time as production becomes inefficient.

Obviously, many other variations and modifications of this invention as previously set forth may be made without departing from the spirit and scope of this invention as those skilled in the art readily understand. Such variations and modifications are considered part of this invention and within the purview and scope of the appended claims.

What is claimed is:

1. A method for stimulating a formation penetrated by a horizontal wellbore comprising:

(a) perforating a horizontal wellbore along its top side at desired intervals so as to enable fluid communication with said formation;

(b) fracturing hydraulically said formation through perforations in said wellbore with a fracturing fluid containing a substantially lightweight proppant which has a density substantially equal to said fluid thereby creating a fracture within a first interval of the formation and maximizing multilayer proppant placement within said fracture;

(c) releasing hydraulic pressure on said formation thereby causing said fracture to be propped with said proppant;

(d) placing ball sealers in said fracturing fluid in an amount sufficient to close perforations in said wellbore adjacent said first interval;

(e) applying pressure in an amount sufficient to fracture said formation in an area adjacent to said first interval which causes said ball sealers to seal off perforations in said first interval and direct fluid into a second perforated interval of said wellbore thereby fracturing the formation adjacent to said second interval; and (f) releasing pressure applied to said fluid thereby maximizing multilayer proppant placement and causing the ball sealers to float upwardly with said fluid through said wellbore where they are recovered.

2. The method as recited in claim 1 where said ball sealers are buoyant.

3. The method as recited in claim 1 where after step (f), steps (b) through (e) are repeated until the desired number of intervals have been fractured in the formation.

4. The method as recited in claim 1 where said proppant consists essentially of a fused material.

5. The method as recited in claim 1 where the specific gravity of said fluid is from about 0.40 to about 1.20 gm/cc and the specific gravity of said proppant is from about 0.40 to about 1.20 gm/cc.

6. A method for stimulating a formation penetrated by a horizontal wellbore comprising:

(a) perforating a horizontal wellbore along its top side at desired intervals so as to enable fluid communication with said formation;

(b) fracturing hydraulically said formation through perforations in said wellbore with a fracturing fluid containing a substantially lightweight proppant which has a density substantially equal to said fluid thereby creating a fracture within one interval of the formation thereby maximizing multilayer proppant placement in said fracture;

(c) releasing hydraulic pressure on said formation thereby causing said fracture to be propped with said proppant;

(d) placing ball sealers in said fracturing fluid in an amount sufficient to close perforations in said wellbore adjacent said fracture;

(e) applying pressure in an amount sufficient to fracture said formation in another area adjacent another perforated interval of said wellbore which causes ball sealers to seal off perforations communicating with said fracture and direct fluid into the other interval thereby creating a fracture in another interval of the formation;

(f) releasing pressure applied to said fluid thereby maximizing multilayer proppant placement and causing the ball sealers to float upwardly with said fluid through said wellbore where they are recovered;

(g) placing ball sealers in said fracturing fluid in an amount sufficient to close perforations in said wellbore adjacent all fractures; and (h) repeating steps e), f), and g) until all desired intervals of the formation have been fractured.

7. The method as recited in claim 6 where hydrocarbonaceous fluids are removed from the formation after all desired intervals have been fractured.

8. The method as recited in claim 6 where said proppant is a substantially fused material.

9. The method as recited in claim 6 where said proppant consists essentially of silica, oxides, glasses, high-strength ceramic products, sintered alumina, and hard procelains.

10. The method as recited in claim 6 where the specific gravity of said fluid is from about 0.40 to about 1.20 gm/cc and the specific gravity of said proppant is from about 0.40 to about 1.20 gm/cc.

11. The method as recited in claim 6 where said ball sealers are buoyant.

* * * * *